United States Patent [19]

Suga et al.

[11] Patent Number: 4,572,748

[45] Date of Patent: Feb. 25, 1986

[54] METHOD OF MANUFACTURING HIGH TENSILE STRENGTH STEEL PLATES

[75] Inventors: Masataka Suga, Tokyo; Makoto Yamada; Kazuhide Takahashi, both of Kanagawa; Nobuhiro Iwasaki, Hiroshima; Kazuyuki Matsui, Hiroshima; Toru Izawa, Hiroshima; Itaru Watanabe, Kanagawa; Hisatoshi Tagawa, Kinosho, all of Japan

[73] Assignee: Nippon Kokan Kabushiki Kaisha, Tokyo, Japan

[21] Appl. No.: 722,763

[22] Filed: Apr. 15, 1985

Related U.S. Application Data

[63] Continuation of Ser. No. 556,026, Nov. 29, 1983, abandoned.

[30] Foreign Application Priority Data

Nov. 29, 1982 [JP] Japan ..... 57-207629

[51] Int. Cl.[4] ..... C21D 1/18; C21D 1/62

[52] U.S. Cl. ..... 148/12 F; 148/12.4

[58] Field of Search ..... 148/12 F, 12.4

[56] References Cited

U.S. PATENT DOCUMENTS

| | | | |
|---|---|---|---|
| 4,105,474 | 8/1978 | Nakasugi et al. | 148/12 F |
| 4,138,278 | 2/1979 | Nakasugi et al. | 148/12 F |
| 4,395,296 | 7/1983 | Abrams | 148/12.4 |
| 4,397,697 | 8/1983 | Freier et al. | 148/12 F |

FOREIGN PATENT DOCUMENTS

| | | | |
|---|---|---|---|
| 131126 | 10/1980 | Japan | 148/12.4 |
| 23224 | 3/1981 | Japan | 148/12.4 |
| 35722 | 4/1981 | Japan | 148/12 F |
| 108220 | 7/1982 | Japan | 148/12 F |
| 158320 | 9/1982 | Japan | 148/12 F |

*Primary Examiner*—Wayland Stallard

*Attorney, Agent, or Firm*—Frishauf, Holtz, Goodman & Woodward

[57] ABSTRACT

The steel plate having a high tensile strength is manufactured from a steel consisting essentially of 0.04–0.16% by weight of C, 0.02–0.50% by weight of Si, 0.4–1.2% by weight of Mn, 0.2–5.0% by weight of Ni, 0.2–1.5% by weight of Cr, 0.2–1.0% by weight of Mo, 0.01–0.10% by weight of acid soluble Al, 0.03–0.15% by weight of one or more of V, Ti and Nb, 0.015% or less by weight of P, 0.006% or less by weight of S and the balance of iron and inherent impurities. The steel is heated to a temperature above a temperature at which carbo-nitrides of V and Nb and carbides of Ti become complete solid solution state, rolled with total reduction of 40% or more below 950° C., quenched by simultaneous cooling immediately after completion of the rolling from a temperature above $(A_3-50)$°C. and tempered at a temperature lower than $Ac_1$ temperature. The density of cooling water (W) for the quenching is detemined by the following equation (I) or (II) in accordance with the plate thickness (t):

(I) for the plate over 40 mm thickness $$W=0.7 \text{ to } 1.5 \text{ m}^3/\text{min}\cdot\text{m}^2$$

(II) for the plate over 25 mm and under 40 mm thickness $$W=0.7 \text{ to } (8.5-0.1\,t)/3 \text{ m}^3/\text{min}\cdot\text{m}^2.$$

2 Claims, 3 Drawing Figures

METHOD OF MANUFACTURING HIGH TENSILE STRENGTH STEEL PLATES

This application is a continuation of application Ser. No. 556,026, filed Nov. 29, 1983, now abandoned.

BACKGROUND OF THE INVENTION

This invention relates to a method of manufacturing high tensile strength steel plates, in particular to a method of manufacturing steel plates with thickness over 25 mm and tensile strength over 80 kg/mm$^2$.

There is a strong need for steel plates with tensile strength over 80 kg/mm$^2$, with high notch toughness and good weldability. The prior art steel of these strength levels were manufactured by reheat-quenching and tempering process. However, so-called direct quenching process, wherein a steel plate is quenched immediately after hot rolling, has been recently introduced to plate production.

The direct-quenched steel exhibit higher hardenability compared with that of conventionally reheat-quenched steel with the same chemical composition. By utilizing the beneficial effect of direct-quenching process, the amount of the alloying elements can be decreased which leads to the improvement in the weldability.

However, the prior art direct-quenching process has a disadvantage in obtaining uniform mechanical properties along the longitudinal and thickness directions. Thus, it is still difficult to manufacture a plate by the direct-quenching process which satisfies the recent increasing demand for the high toughness at any portion within the plate.

The nonuniformity along the longitudinal direction is caused by the conventional cooling method in which quenching is carried out continuously. According to the continuous quenching method, the plate is quenched continuously from its head to tail end by passing the plate through a relatively short cooling zone with high cooling water density. According to this method, it takes more than few minutes to quench the entire length of the plate, thus cause variation in the time to start quenching after rolling along the longitudinal direction. During the duration time, recovery and recrystalization of austenite would occur together with the temperature drop of the steel plate. Such change in the austenite condition and temperature along the plate will result in the nonuniformity of the mechanical properties along the longitudinal direction.

Such problem can be avoided by using static cooling method, wherein the plate is placed in the cooling zone longer than the plate and perform quenching of the entire length of the plate simultaneously. The reason why the continuous quenching method has been nevertheless adopted in most mill is that it was believed that the high quenching rate is necessary for the improvement in mechanical properties and weldability.

The quenching rate increases as the cooling water density (amount of water flow per unit time and unit area) increases. On the other hand, the total amount of water available for in-line quenching is limited. Consequently, the length of the quenching zone has to be limited in order to obtain high water density and thus high quenching rate. When the length of the quenching zone become shorter than the length of the plate to be processed, then the continuous method has to be adopted.

The nonuniformity in the thickness direction is caused by the difference in the cooling rate between the surface and the core portion of the plate. The difference is enhanced when the thickness of the plate and/or the water density increases. The difference in cooling velocity results in the variation in the resultant microstructure of the steel and thus the inhomogeneity in mechanical properties.

Such problem had been recognized already and some ideas to solve the problem had been proposed.

For example, Japanese patent laid-open publication No. 101613/1977 discloses a method for decreasing the difference in cooling velocity between the vicinity of surface and the core portion. According to this method, the steel plate is passed through strong cooling zone and soft cooling zone provided alternatively. However, this method can be applied only for the continuous quenching, thus the inhomogeneity in the longitudinal direction can not be avoided.

The problem becomes significant when the thickness exceeds 25 mm and the tensile strength exceeds 80 kg/mm$^2$.

Such high strength steel exhibits the optimum strength and toughness when it has a mixed structure of martensite and lower bainite. When either the alloy content or cooling rate is too high, then the micro-structure after quenching becomes single martensite phase, and the toughness degrades. When either two is too low, then upper bainite will be included, and both toughness and strength degrades.

In other words, there is an optimum quenching rate for given chemical composition of a steel. Therefore, where there is a large quenching rate distribution in the thickness direction of the plate, it becomes impossible to obtain an optimum micro-structure and thus the best mechanical properties throughout the entire thickness.

SUMMARY OF THE INVENTION

The object of this invention is therefore to provide a method for manufacturing a high strength steel plate with uniform mechanical properties in both longitudinal and thickness directions by direct quenching process.

Another object of this invention is to provide a method of manufacturing a steel plate having a thickness over 25 mm and a tensile strength over 80 kg/mm$^2$ with excellent weldability in addition to the excellent toughness.

According to this invention there is provide a method of manufacturing a high tensile strength steel plate comprising the steps of heating steel consisting essentially of 0.04–0.16% by weight of carbon, 0.02–0.50% by weight of silicon, 0.4–1.2% by weight of manganese, 0.2–5.0% by weight of nickel, 0.2–1.5% by weight of chromium, 0.2–1.0% by weight of molybdenum, 0.01–0.10% by weight of acid soluble aluminum, 0.03–0.15% by weight of one or more of vanadium, titanium and niobium, 0.015% or less by weight of phosphorus, 0.006% or less by weight of sulfur, and the balance of iron and inherent impurities, to a temperature above a temperature at which carbo-nitrides of vanadium and niobium and carbides of titanium become complete solid solution state, rolling the steel with total reduction of 40% or more below 950° C., quenching the rolled steel plate by simultaneous cooling immediately after completion of the rolling from a temperature above ($A_3-50$)° C., and tempering the steel plate at a temperature lower than $Ac_1$ temperature, density of cooling water (W) for the quenching being determined by the following equation (I) or (II) in accordance with the plate thickness (t):

(I) for the plate over 40 mm thickness $$W=0.7 \text{ to } 1.5\ m^3/min\cdot m^2$$

(II) for the plate over 25 mm and under 40 mm thickness $$W=0.7 \text{ to } (8.5-0.1t)/3m^3/min\cdot m^2$$

DESCRIPTION OF THE PREFERRED EMBODIMENT

A strong quenching device has problem in obtaining uniform cooling rate, and thus problem in obtaining uniform quality, through thickness direction.

Figure 1:
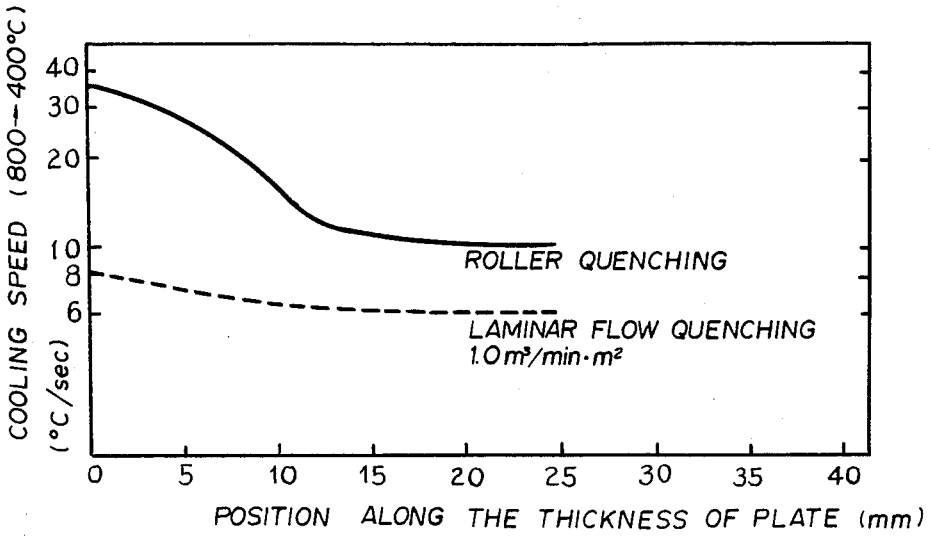
FIG. 1 is a graph showing the relation between the position along the thickness direction and the cooling rate.

The upper curve of FIG. 1 shows the through thickness distribution of the cooling rate of a 50 mm thick plate cooled by roller quenching device (cooling water density of 5.0 $m^3/min\cdot m^2$), a typical strong cooling device presently used. The curve shows that the cooling rate at the surface portion is about three times larger than that of the core portion.

The lower curve shows the cooling rate distribution where laminar flow quenching with the cooling water density of 1.0 $m^3/min\cdot m^2$ is applied to the same thickness plate. In this case, the difference of the cooling rate between the surface and the core portion is scarce.

Figure 3:
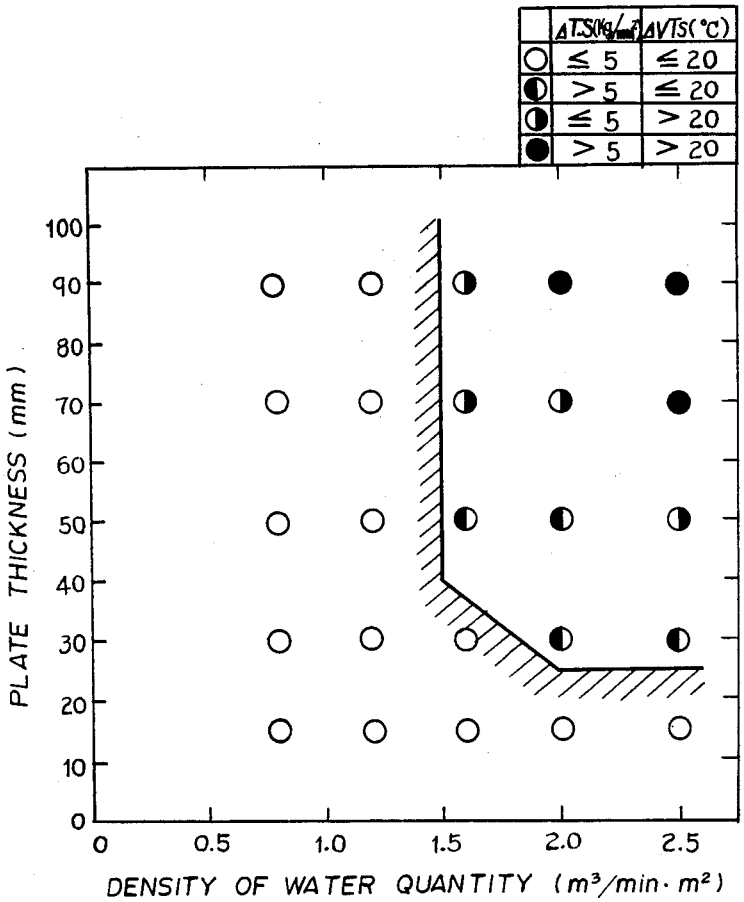
FIG. 3 is a graph showing the relation between the plate thickness and the density of cooling water taking the difference in the strength (ΔTS) and the difference in the toughness (ΔvTs) as parameters.

From this figure, it is clear that controlled cooling is necessary for heavy section plate to obtain uniform cooling rate through thickness direction. However, the cooling rate itself also decreases as the water density decreases. Thus the optimum range of the water density, where uniformity is maintained without degrading weldability, has to be determined. FIG. 3 is summarizing how the mechanical properties get affected by the water density and the plate thickness for the high strength steel with tensile strength over 80 $kg/mm^2$.

FIG. 3 shows how the difference in the strength and/or toughness between surface and core portions changes according to the plate thickness and cooling water density. When the cooling water density exceeds 1.5 $m^3/min\cdot m^2$ for the plate over 40 mm thickness, the difference in the strength between the surface and the core portion becomes more than 5 $kg/mm^2$ and/or the difference in the fracture appearance transition temperature becomes more than 20° C. In plates less than 25 mm thickness, uniformity in the thickness direction is maintained irrespective of the water density. For the plate with thickness between 25 to 40 mm, the water density should satisfy the following equation: $W=0.7$ to $(8.5=0.1t)/3m^3/min\cdot m^2$ On the other hand, when the water density decreases below 0.7 $m^3/min\cdot m^2$, the quenching rate becomes so small that the increase in alloy content becomes necessary and thus degrade weldability otherwise the high strength level can not be maintained. Thus the water density should be over 0.7 $m^3/min\cdot m^2$.

The optimum water density concluded from our investigation is less than one third of the conventional roller quenching device. It means that the length of the cooling zone can be more than trippled compared with conventional device providing that the same amount of cooling water can be supplied. Such long cooling zone is applicable to static cooling system which is advantageous for obtaining uniform mechanical properties along the longitudinal direction.

Figure 2:
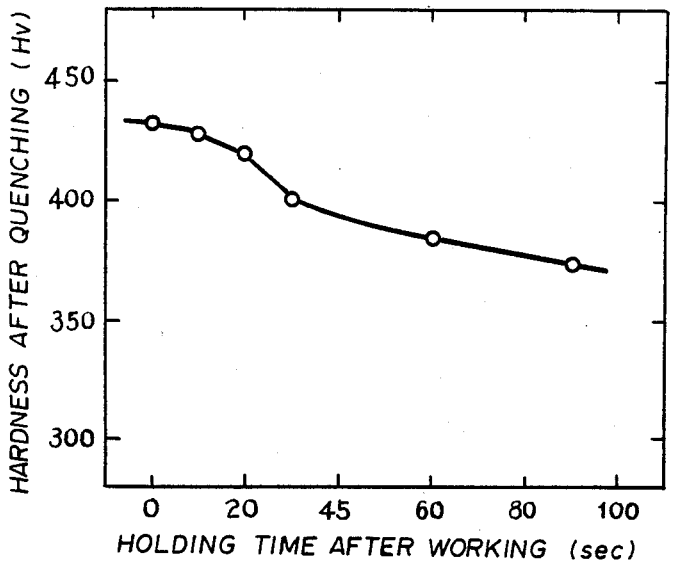
FIG. 2 is a graph showing the relation between the holding time after working prior to quenching and the as quenched hardness.

FIG. 2 shows the relationship between the as quenched hardness and the holding time after hot working at the deformation temperature prior to quenching. As can be seen from figure, the hardness decreases as the time period increases. The hardness decrease should be due to the recovery and/or recrystalization of austenite. When the continuous quenching method is adopted in direct quenching system, additional decrease in hardenability should occur because of the temperature drop during the holding time. This will result in the nonuniformity in mechanical properties along the longitudinal direction.

The conclusion from these figures is that the static cooling system with controlled cooling is necessary for the in-line direct quenching system of the over 80 $kg/mm^2$ strength level heavy section plate in order to obtain uniformity along the longitudinal and thickness directions.

However, the decrease in cooling rate by controlled cooling should be compensated by the efficient use of Nb, V and Ti, which is possible only through the direct quenching system.

Regarding the influence of V, Nb or Ti on the hardenability on steel, two contradictry results are reported so far, one improving and the other degrading.

However, our investigation revealed that these elements will improve the hardenability whenever they exist in the austenite as solid solution. On the other hand, if these elements remain undissolved in the austenite as carbides or carbo-nitrides the hardenability will degrade.

In the case of reheat quenching process, the reheating temperature must be lower than the grain coarsening temperature. Thus the temperature around 900° C. is generally used, which is lower than the dissolving temperature of these carbides and carbo-nitrides. The dissolving temperature of the carbides or carbo-nitrides can be calculated using the solubility products available in literatures.

The grain size of the direct quenched steel is refined by the successive deformation and recrystalization during the rolling process thus the slab can be reheated above the grain coarsening temperature, which is higher than the dissolving temperature of these precipitates, and still obtain refined grain size.

Those elements are not only advantageous for hardenability but also for strengthning after tempering. Those steels with these elements show strong resistance to softening by precipitating fine carbides and/or carbonitrides of these elements during tempering process. By effectively utilizing these elements through direct quenching process, high tensile strength can be maintained without increasing the carbon equivalent of the steel.

From this respect, the alloy content of Nb, V and Ti and the slab heating temperature are important in this invention. The total amount of Nb, V and Ti should be at least 0.03%, but when the sum exceeds 0.15% the toughness of weldment decreases. Accordingly, the total amount of these elements should not exceed 0.15%.

The optimization of the each step of the direct quenching process is also important in this invention.

The slab heating temperature should be higher than the dissolving temperature of carbides and/or carbonitrides of Nb, V and Ti, as mentioned above.

The high hardenability obtained by direct quenching process seems to be related with the deformation of austenite, similar to the so-called ausforming process. As shown in FIG. 2, it is preferable to quench before the recrystalization has completed, in other words, before the effect of deformation disappears.

For this reason, the relatively low rolling temperature, where recrystalization get sluggish, is recommended prior to the quenching.

More specifically, the rolling pass schedule with total reduction of over 40% is required under 950° C. for the best results.

The quench start temperature should be high enough so as not to hinder hardenability. The temperature should be higher than $(A_3-50)$° C. for the steel of this invention.

The final rolling temperature should be selected so as to maintain the quench start temperature higher than $(A_3-50)$° C. The time between the last rolling pass and the beginning of quenching is preferable to be as short as possible from the hardenability viewpoint, as mentioned earlier with FIG. 2.

The chemical composition of the steel of this invention is characterized in the beneficial use of Nb, V and Ti, as mentioned before. The alloy content of the other alloying elements are limited for the following reason.

C is the most basic element to obtain strength. To maintain the strength level over 80 kg/mm$^2$, at least 0.04% C is required. But the weldability will degrade and the susceptibility to cold cracking become too high when the quantity exceeds 0.16%. So the range of C is limited from 0.04 to 0.16%.

Si is inevitable in steelmaking and at least 0.02% Si should contain in steel. However, when the Si content exceeds 0.5%, the toughness of weldment decrease because of the increase in martensite-austenite constituent at the heat affected zone of the weldment. Thus the Si range is limited to 0.02 to 0.5%.

P and S are harmful impurities to toughness, thus the content of these elements should be limited below 0.015% and 0.006% respectively.

Cr contributes to the improvement of hardenability, thus at least 0.2% of Cr is required for the strength level of the steel of this invention. However, its quantity exceeds 1.5%, not only the increase in Ceq but also the susceptibility to SR cracking increases. So the range is limited from 0.2% to 1.5%.

Mo is a very effective element to increase strength of quenched and tempered steel, since it improves not only the hardenability but also the resistance to softening by tempering. Thus, at least 0.2% of Mo is necessary to obtain the required strength level of this invention. However, Mo is an expensive alloying element. Thus, it is preferable to maintain the Mo content within the range from 0.2% to 1.0%.

Al is an indispensable element for deoxidation. At least 0.01% of acid soluble aluminum is required to avoid the contamination of oxide inclusions. However, when its quantity exceeds 0.10%, the toughness of the plate decreases. For this reason, sol.Al should be within the range from 0.01 to 0.1%.

Ni is a very effective element to improve toughness. It is also useful for increasing hardenability with minimum increment in Ceq. However, it is very expensive metal. Thus the range is limited from 0.2 to 5.0%.

Cu and/or B may be added if necessary. Cu contributes to strengthening through improvement in hardenability and precipitation hardening. But when the amount exceeds 0.5%, it increases the susceptibility to SR cracking as well as surface defects of the rolled plates. Accordingly, the Cu content should be less than 0.5%.

Micro-alloying of B is effective in improving the hardenability of steel without increasing Ceq. However, addition over 0.002% does not result in any additional advantages, so the quantity is limited below 0.002%.

The shape control of the sulfide inclusion by REM (rare earth metal) or Ca is also effective for improving toughness in the same manner as the prior art steel.

Decrease of nitrogen and oxygen is also preferable in improving toughness.

Steels prepared by the method of this invention had the chemical compositions shown in the following Table I.

TABLE I

| | | Chemical Composition of Steel | | | | | | | | | | | | | | | |
|---|---|---|---|---|---|---|---|---|---|---|---|---|---|---|---|---|---|
| | sample steel No. | C | Si | Mn | P | S | Cu | Ni | Cr | Mo | V | Nb | Ti | B | sol.Al | Ceq | $A_3$ (°C.) |
| this invention | 1 | 0.08 | 0.22 | 0.80 | 0.005 | 0.002 | — | 1.99 | 0.49 | 0.48 | 0.107 | — | — | 0.001 | 0.050 | 0.498 | 844 |
| | 2 | 0.09 | 0.28 | 0.83 | 0.003 | 0.001 | — | 2.00 | 0.50 | 0.49 | 0.100 | — | — | — | 0.018 | 0.520 | 844 |
| | 3 | 0.10 | 0.26 | 0.76 | 0.002 | 0.001 | — | 3.08 | 0.50 | 0.51 | 0.109 | — | — | — | 0.048 | 0.550 | 822 |
| | 4 | 0.08 | 0.38 | 0.60 | 0.004 | 0.003 | 0.34 | 1.00 | 0.40 | 0.47 | 0.093 | — | — | 0.001 | 0.065 | 0.425 | 866 |
| | 5 | 0.11 | 0.06 | 0.84 | 0.004 | 0.004 | — | 2.05 | 0.49 | 0.51 | 0.061 | 0.023 | 0.011 | — | 0.063 | 0.534 | 819 |
| Control | 7 | 0.11 | 0.39 | 0.87 | 0.004 | 0.003 | 0.34 | 0.89 | 0.55 | 0.46 | — | — | — | 0.001 | 0.066 | 0.519 | 858 |
| | 8 | 0.03 | 0.21 | 0.89 | 0.002 | 0.001 | — | 1.55 | 0.51 | 0.78 | 0.14 | — | — | 0.001 | 0.053 | 0.053 | 848 |

At least 0.40% of Mn is necessary to assure hardenability, but when it exceeds 1.20% not only the degrade in weldability but also susceptibility to temper embrittlement increases. So the Mn range is limited to 0.4 to 1.20%.

The slab heating temperature, the reduction percentage at a temperature below 950° C., the cooling start temperature, the density of cooling water, the heat treatment after rolling the plate thickness are shown in the following Table II.

TABLE II

| sample steel No. | sample plate No. | slab heating temp. (°C.) | reduction (%) below 950° C. | cooling start temp. (°C.) | density of cooling water ($m^3$/min · $m^2$) | heat treatment after rolling | plate thickness (mm) | |
|---|---|---|---|---|---|---|---|---|
| 1 | 1a | 1200 | 60 | 850 | 1.0 | tempering | 50 | this invention |
| 1 | 1b | — | — | — | — | quenching tempering | 50 | control |
| 1 | 1c | 1200 | 60 | 850 | 5.0 | tempering | 50 | control |
| 2 | 2a | 1150 | 50 | 830 | 1.0 | tempering | 50 | this invention |
| 2 | 2b | 1150 | 10 | 880 | 1.4 | tempering | 50 | control |
| 3 | 3a | 1180 | 60 | 850 | 0.9 | tempering | 50 | this invention |
| 3 | 3b | 1180 | 50 | 850 | 1.0 | tempering | 75 | this invention |
| 3 | 3c | 1180 | 60 | 750 | 1.0 | tempering | 75 | control |
| 4 | 4a | 1150 | 50 | 850 | 1.0 | tempering | 40 | this invention |
| 4 | 4b | 1150 | 50 | 850 | 5.0 | tempering | 40 | control |
| 5 | 5a | 1150 | 50 | 850 | 1.0 | tempering | 50 | this invention |
| 5 | 5b | 950 | 50 | 850 | 1.0 | tempering | 50 | control |
| 7 | 7a | 1150 | 50 | 850 | 1.0 | tempering | 50 | control |
| 8 | 8a | 1150 | 50 | 850 | 1.0 | tempering | 50 | control |

The mechanical properties, that is tensile test values and charpy impact test values of the steel plates of various samples measured at the thickness of t/2 and t/4 (t shows the plate thickness) are shown in the following Table III.

TABLE III

| sample steel No. | sample plate No. | t/2 tensile test value Y S kg/$mm^2$ | t/2 tensile test value T S kg/$mm^2$ | t/2 tensile test value elongation % | t/2 impact value vTs °C. | t/2 impact value vEs kg · m | t/4 tensile test value Y S kg/$mm^2$ | t/4 tensile test value T S kg/$mm^2$ | t/4 tensile test value elongation % | t/4 impact value vTs °C. | t/4 impact value vEs kg · m | |
|---|---|---|---|---|---|---|---|---|---|---|---|---|
| 1 | 1a | 98.0 | 103.5 | 25.3 | −65 | 22.9 | 100.4 | 105.1 | 24.4 | −66 | 21.8 | this invention |
| 1 | 1b | 90.3 | 96.7 | 23.1 | −60 | 22.9 | 92.4 | 98.2 | 24.2 | −30 | 24.1 | control |
| 1 | 1c | 100.2 | 104.8 | 23.8 | −63 | 21.8 | 102.5 | 107.1 | 23.8 | −25 | 20.8 | control |
| 2 | 2a | 95.8 | 100.8 | 23.6 | −82 | 27.8 | 97.4 | 102.2 | 25.4 | −89 | 28.4 | this invention |
| 2 | 2b | 89.0 | 95.3 | 23.8 | −25 | 24.3 | 92.3 | 98.3 | 23.2 | −45 | 24.3 | control |
| 3 | 3a | 107.4 | 110.5 | 23.4 | −108 | 23.3 | 107.4 | 110.8 | 22.6 | −96 | 24.7 | this invention |
| 3 | 3b | 94.9 | 100.9 | 21.8 | −76 | 23.3 | 96.8 | 102.4 | 21.5 | −75 | 23.9 | this invention |
| 3 | 3c | 83.5 | 92.8 | 20.6 | −45 | 18.9 | 85.6 | 94.8 | 21.3 | −35 | 19.2 | control |
| 4 | 4a | 93.0 | 98.3 | 22.6 | −95 | 21.8 | 94.2 | 100.2 | 22.5 | −92 | 20.6 | this invention |
| 4 | 4b | 96.0 | 102.0 | 20.6 | −85 | 20.5 | 99.6 | 106.3 | 18.9 | −23 | 15.8 | control |
| 5 | 5a | 108.2 | 115.3 | 21.3 | −98 | 19.8 | 109.6 | 116.5 | 20.5 | −90 | 18.3 | this invention |
| 5 | 5b | 84.2 | 92.3 | 18.3 | −53 | 18.3 | 86.3 | 94.5 | 17.8 | −47 | 17.5 | control |
| 7 | 7a | 69.8 | 77.2 | 23.1 | −75 | 27.6 | 70.5 | 78.8 | 22.5 | −65 | 26.5 | control |
| 8 | 8a | 74.2 | 79.5 | 22.5 | −30 | 25.3 | 74.8 | 80.1 | 21.8 | −25 | 25.5 | control |

As shown in Table III, the plate sample No. 1a, that is a steel plate of this invention, has a tensile strength of about 100 kg/$mm^2$ even with Ceq of 0.498 which is less than that of the prior art 80 kg/$mm^2$ class high strength steel, and an excellent vTs value of less than −60° C. The plate 1b has the same steel composition as that of the plate 1a, but was obtained by reheating to a temperature of 900° C. followed by quenching in a roller quenching installation (density of cooling water was 5.0 $m^3$/min·$m^2$). The yielding strength (YS) of sample 1b is lower than that of 1a by 8 kg/$mm^2$ and the vTs at t/4 portion is inferior than sample 1a by more than 30° C. Sample 1c was prepared from the same charge, under the same rolling condition, and cooling was effected with the same roller quenching installation and with the same density of cooling water. Sample 1c has substantially the same mechanical strength as sample 1a and the vTs at t/2 portion is the same as 1a. However, at t/4 portion the vTs value is much inferior than that of sample 1a, because at the t/4 portion, the cooling rate will be too high so that the steel was entirely transformed into martensite structure.

Sample 2a was manufactured according to the method of this invention, while sample 2b was obtained with a reduction of 10% below 950° C. In sample 2b, since the reduction below 950° C. is too small, sufficient working and heat treatment effects can not be provided, so that its strength and toughness are lower than those of sample 2a.

Samples 3a and 3b are steel plates manufactured by the method of this invention and have thicknesses of 50 mm and 75 mm respectively and showed excellent mechanical strength and toughness. Sample 3c was prepared from the same charge as samples 3a and 3b and cooling was initiated from a temperature of 750° C., that is below $Ar_3$ point, and its mechanical strength is lower by about 8 kg/$mm^2$ than sample 3b having the same thickness, while vTs is inferior by more than 30° C. It is considered that this was caused by the fact that the hardenabilty was not sufficient.

Sample 4b was obtained by using the same density of cooling water as in the conventional method. The chemical composition, rolling condition, etc. are the same as sample 4a. Although sample 4b has a slightly larger mechanical strength than sample 4a, the difference in vTs at t/2 and t/4 portions is large. Thus the vTs at the t/4 portion is inferior than that of 4a by about 60° C.

Sample 5b was prepared at a slab heating temperature of 950° C. at which temperature the carbides and/or carbo-nitrides of V, Nb and Ti are not sufficiently dissolved in the austenite. For this reason, when compared with sample 5a which was heated to above the dissolving temperature of the carbides and carbo-nitrides, the mechanical strength and toughness are much inferior than sample 5a.

Sample 7a is a control sample not containing Nb, V and Ti. Although its Ceq is high, that is 0.519, it can not provide a tensile strength over 80 kg/mm$^2$.

Since sample 8a has a low carbon content of 0.03%, Ceq is high, that is 0.533, but it does not satisfy the 80 kg/mm$^2$ class strength. Furthermore, the micro-structure after quenching and the toughness is not satisfactory.

For all samples, tempering was carried out at a temperature between 600° C. and 630° C. and the time between the last rolling pass and the beginning of quenching was 15–30 seconds.

According to the method of this invention, it is possible to obtain uniform mechanical properties along both the longitudinal and thickness directions of the steel plate, even with the thickness over 40 mm. Moreover, steel plates having high mechanical strength can be manufactured with a low carbon equivalent (Ceq).

What is claimed is:

1. A method of manufacturing a high tensile strength of at least 90 kg/mm$^2$ steel plate at least 50 mm thick and having substantially uniform physical properties throughout the length and thickness of said plate comprising the steps of heating steel consisting essentially of 0.04–0.16% by weight of carbon, 0.02–0.50% by weight of silicon, 0.4–1.2% by weight of manganese, 0.2–5.0% by weight of nickel, 0.2–1.5% by weight of chromium, 0.2–1.0% by weight of molybdenum, 0.01–0.10% by weight of acid soluble aluminum, 0.03–0.15% by weight of one or more of vanadium, titanium and niobium, 0.015% or less by weight of phosphorus, 0.006% or less by weight of sulfur and the balance of iron and inherent impurities, to a temperature above the temperature at which carbonitrides of vanadium and niobium and carbides of titanium are completely in the solid solution state; rolling the steel with total reduction of at least 40% at a temperature below 950° C., said steel at the completion of said rolling being at a temperature above $(A_3-50)$° C. and a thickness (t) of at least 50 mm; quenching the rolled steel plate by simultaneous cooling the entire steel plate immediately after completion of the rolling from a temperature above $(A_3-50)$° C.; and tempering the steel plate at a temperature lower than $Ac_1$ temperature; the density of cooling water (W) for the quenching being determined by the following equation:

$$W=0.7 \text{ to } 1.5 m^3/min \cdot m^2$$

2. The method according to claim 1 wherein said steel further contains one or both of 0.002% or less by weight of boron and 0.5% or less by weight of copper.

* * * * *